US008007339B2

(12) United States Patent
Hardin et al.

(10) Patent No.: US 8,007,339 B2
(45) Date of Patent: Aug. 30, 2011

(54) VIRTUAL CHARACTER VIDEO TOY WITH MOVABLE DISPLAY

(75) Inventors: Mark Hardin, Austin, TX (US); Dominic Ambriz, Playa Del Ray, CA (US); Evelyn Viohl, Redondo Beach, CA (US)

(73) Assignee: Mattel, Inc., El Segundo, CA (US)

( * ) Notice: Subject to any disclaimer, the term of this patent is extended or adjusted under 35 U.S.C. 154(b) by 1270 days.

(21) Appl. No.: 11/592,749

(22) Filed: Nov. 3, 2006

(65) Prior Publication Data

US 2007/0178980 A1 Aug. 2, 2007

Related U.S. Application Data

(60) Provisional application No. 60/733,549, filed on Nov. 4, 2005, provisional application No. 60/756,744, filed on Jan. 6, 2006, provisional application No. 60/849,338, filed on Oct. 2, 2006, provisional application No. 60/849,264, filed on Oct. 2, 2006.

(51) Int. Cl.
*A63H 3/36* (2006.01)

(52) U.S. Cl. ..... 446/175; 446/73; 446/478

(58) Field of Classification Search ..... 446/478, 446/82–84, 175; 345/204–206; 40/409, 40/411, 124.06
See application file for complete search history.

(56) References Cited

U.S. PATENT DOCUMENTS 3,182,420 A 5/1965 Bender
4,226,044 A 10/1980 Thomas
4,398,723 A 8/1983 Erickson et al.
4,421,317 A 12/1983 Hector et al.
5,013,278 A * 5/1991 Dixon et al. ..... 446/73
5,312,284 A 5/1994 Grober et al.
5,716,211 A 2/1998 Vetter
RE35,819 E 6/1998 Suzuki
5,966,526 A 10/1999 Yokoi
6,056,618 A 5/2000 Larian
6,165,068 A 12/2000 Sonoda et al.
6,213,871 B1 4/2001 Yokoi
6,227,931 B1 5/2001 Shackelford
6,227,966 B1 5/2001 Yokoi
6,273,815 B1 8/2001 Stuckman et al.
6,394,903 B1 5/2002 Lam
(Continued)

OTHER PUBLICATIONS

An International Search Report from International Application No. PCT/US06/43407, mailed Sep. 12, 2007.

(Continued)

*Primary Examiner* — Dmitry Suhol
*Assistant Examiner* — Alex F. R. P. Rada, II
(74) *Attorney, Agent, or Firm* — Kolisch Hartwell, PC

(57) ABSTRACT

A video toy is provided which may include a video screen and first and second housing segments. Each housing segment may have a diorama displaying features and objects to simulate a scene such as an apartment or room. The video screen may move from a position in front of a first diorama to a position in front of a second diorama. The diorama behind the video screen may be visible through the screen. The video toy may be programmed to display characters on the screen that engage in activities consistent with the diorama visible through the video display and simulate interacting with objects in the diorama. Players may interact with the characters through inputs such as buttons. Virtual characters may be programmed to have activities and interactions with the player that are modified based on type and frequency of user inputs.

13 Claims, 8 Drawing Sheets

U.S. PATENT DOCUMENTS

| | | | |
|---|---|---|---|
| 6,449,518 | B1 | 9/2002 | Yokoo et al. |
| 6,454,570 | B1 | 9/2002 | Woods |
| 6,461,238 | B1 | 10/2002 | Rehkemper et al. |
| 6,500,070 | B1 | 12/2002 | Tomizawa et al. |
| 6,537,149 | B2 | 3/2003 | Sogabe |
| 6,609,968 | B1 | 8/2003 | Okada et al. |
| 6,652,383 | B1 | 11/2003 | Sonoda et al. |
| 6,722,973 | B2 | 4/2004 | Akaishi |
| 6,744,152 | B2 | 6/2004 | Kroll |
| 6,832,955 | B2 | 12/2004 | Yokoi |
| 6,896,573 | B1 | 5/2005 | Rogers |
| 6,937,152 | B2 | 8/2005 | Small |
| D532,461 | S | 11/2006 | Levine et al. |
| D533,773 | S | 12/2006 | Sander |
| D535,707 | S | 1/2007 | Levine et al. |
| D536,042 | S | 1/2007 | Levine et al. |
| 7,370,974 | B2 | 5/2008 | Yamada et al. |
| 7,371,177 | B2 | 5/2008 | Ellis et al. |
| 7,387,237 | B2 | 6/2008 | Main |
| 7,556,563 | B2 | 7/2009 | Ellis et al. |
| 7,607,962 | B2 | 10/2009 | Hardin |
| 7,704,146 | B2 | 4/2010 | Ellis |
| 2002/0115482 | A1 | 8/2002 | Taub |
| 2003/0216160 | A1 | 11/2003 | Yokoi |
| 2004/0133354 | A1 | 7/2004 | Low et al. |
| 2004/0166936 | A1 | 8/2004 | Rothschild et al. |
| 2004/0166937 | A1 | 8/2004 | Rothschild et al. |
| 2004/0259635 | A1 | 12/2004 | Germeraad |
| 2005/0024313 | A1 | 2/2005 | Nakajima et al. |
| 2005/0119037 | A1 | 6/2005 | Yokoi |
| 2005/0192084 | A1 | 9/2005 | Iwamoto |
| 2005/0245302 | A1 | 11/2005 | Bathiche |
| 2006/0157318 | A1 | 7/2006 | Gao |
| 2006/0160588 | A1 | 7/2006 | Yamada et al. |
| 2007/0178980 | A1 | 8/2007 | Hardin et al. |
| 2007/0247439 | A1 | 10/2007 | Daniel et al. |
| 2008/0108272 | A1 | 5/2008 | Lin |
| 2008/0113586 | A1 * | 5/2008 | Hardin et al. ..... 446/477 |
| 2008/0139265 | A1 | 6/2008 | Hardin et al. |
| 2009/0176432 | A1 | 7/2009 | Hardin |

OTHER PUBLICATIONS

State Intellectual Property Office of P.R.C.; Office action received in corresponding Chinese Patent Application No. 200680050293.8 dated Sep. 11, 2009.

* cited by examiner

VIRTUAL CHARACTER VIDEO TOY WITH MOVABLE DISPLAY

CROSS-REFERENCES

This application claims priority to U.S. Provisional Application Ser. No. 60/733,549, filed Nov. 4, 2005, and entitled "Virtual Character Video Toy," U.S. Provisional Application Ser. No. 60/756,744, filed Jan. 6, 2006, and entitled "Virtual Character Video Toy," U.S. Provisional Application Ser. No. 60/849,338 filed Oct. 2, 2006, and entitled "Video Toy with Backgrounds and Movable Screen," U.S. Provisional Application Ser. No. 60/849,264 filed Oct. 2, 2006, and entitled "Video Toy with Backgrounds and Alternate Backgrounds," incorporated herein by reference.

BACKGROUND

This disclosure relates to toys with video screens and more specifically relates to toys that may have transparent video screens displaying virtual characters that respond to player inputs and are presented in association with diorama backgrounds.

Examples of video screen toys are found in the following patents and published patent applications: U.S. Pat. No. 4,398,723, U.S. Pat. No. 4,421,317, U.S. Pat. No. 5,966,526, U.S. Pat. No. 6,056,618, U.S. Pat. No. 6,165,068, U.S. Pat. No. 6,213,871, U.S. Pat. No. 6,227,966, U.S. Pat. No. 6,273,815, U.S. Pat. No. 6,449,518, U.S. Pat. No. 6,461,238, U.S. Pat. No. 6,500,070, U.S. Pat. No. 6,537,149, U.S. Pat. No. 6,609,968, U.S. Pat. No. 6,652,383, U.S. Pat. No. 6,722,973, U.S. Pat. No. 6,832,955, US2003/0216160, US2004/0133354, US2004/0259635, US2002/0115482, US2005/0119037, US2005/024313, US2005/0245302, and RE35,819. The disclosures of all the patent applications, patent publications, patents and other publications recited in this application are incorporated herein by reference in their entirety for all purposes.

SUMMARY

An interactive video toy is provided that may display at least one virtual character on a transparent video screen. The screen may be attached to a housing including dioramas. The screen may move between a first position with a first diorama visible through the screen and a second position with a second diorama visible through the screen. One or more characters on the screen may appear to be superimposed on the diorama and may appear to interact with diorama objects, such as by sitting on a chair of the diorama. A character may appear to move between dioramas when the screen is rotated to a new position.

Dioramas may have fixtures and features that define the room type or theme. For example, a first diorama may have a television and a sofa in a living room. A second diorama may have a stove, a refrigerator and a table in a kitchen. Other indoor or outdoor themes may also be used. The character when displayed on the screen may respond to the adjacent diorama and engage in activities compatible or consistent with the diorama theme.

For example, with the screen positioned in front of the first diorama, the character may appear to be in a living room and pursue activities associated with free or leisure time. Moving the screen to a position in front of the second diorama, the character may appear to be in a kitchen and may pursue activities associated with cooking.

A user may interact with the character and solicit responses by pressing one or more buttons or providing other input. Buttons may be located on the front or other convenient part of the toy. Each button may be associated with a particular kind of input, or with different buttons providing different kinds of input to allow different kinds of interaction with the characters. Buttons may also provide the same kind of input to allow multiple inputs of the same type. Buttons may be associated with any characteristic or feature associated with a character or theme. For example, buttons may provide inputs associated with eating, socializing and/or doing chores and buttons related to eating may provide inputs for eating solid food, drinking and cooking. Characters may initiate actions independently with no input from the player. The feature or characteristic associated with a button may be different for different themes.

Characters in the video toy may be programmed to engage in additional activities as game play progresses. These additional activities may be associated with the interactions and inputs provided by the player. The character may appear to develop skills and/or personal development. Lack of input from the player may evoke expressions of sadness, loneliness or boredom from the character. Extended lack of input may cause the character to appear to pack and move out of the video toy.

The plural dioramas may be fixed relative to each other or move between relative open and closed positions. The video screen and body segments supporting dioramas may be placed in a closed position in which the screen may be enclosed between body segments, which body segments may protect the screen from damage. The closed position may expose a handle for transporting the toy.

DETAILED DESCRIPTION

Figure 1:
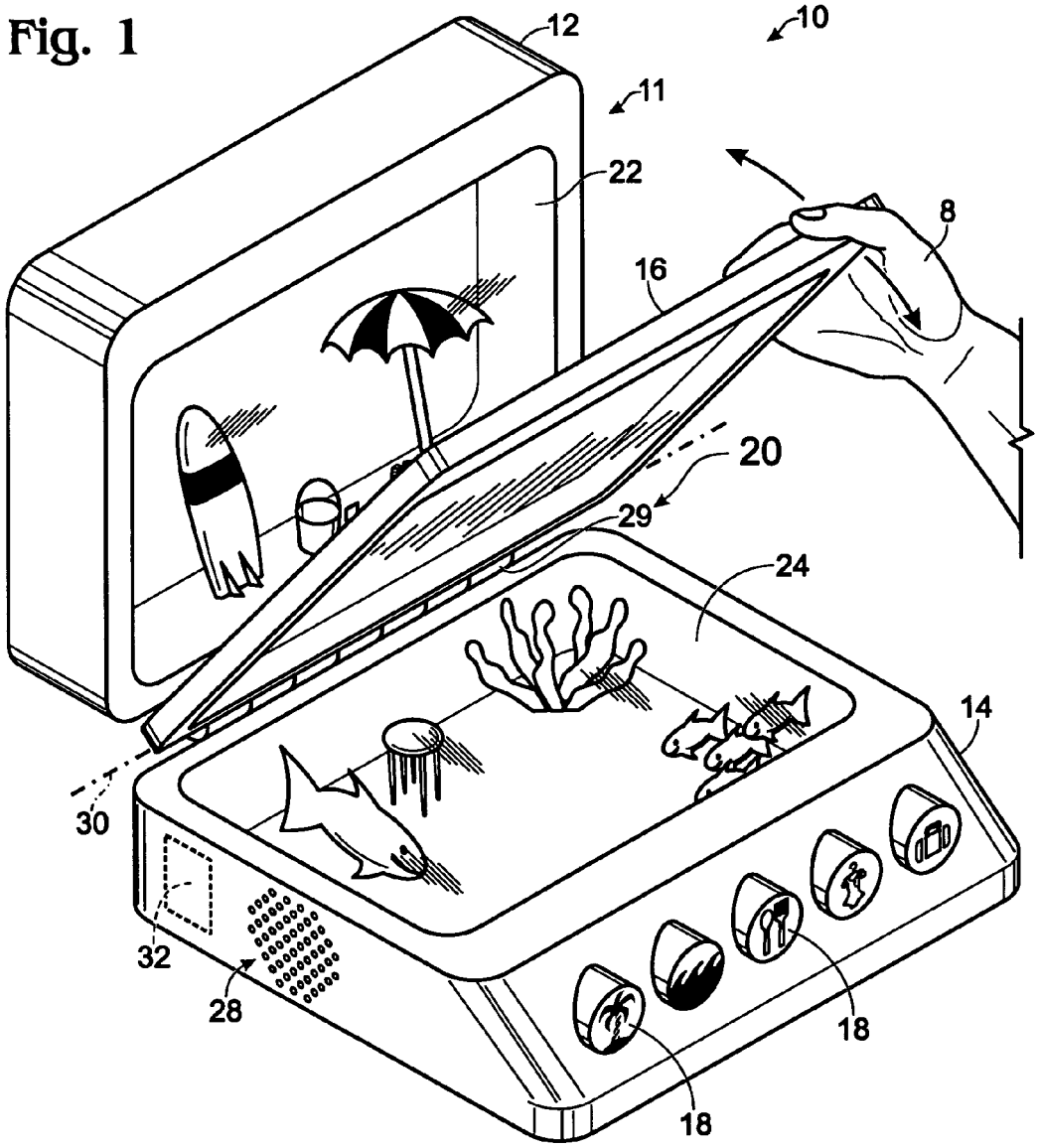
FIG. 1 is a perspective view of an exemplary video toy including a first housing segment and a second housing segment with a first diorama and a second diorama respectively, control inputs, a speaker, a sensor and a video screen being moved by a user from a first position in front of the first diorama to a second position in front of the second diorama.

FIG. 1 is a perspective view of a user 8 with an illustrative example of a video toy 10. Toy 10 includes a housing 11 including a first housing segment 12 and a second housing segment 14, a transparent video screen 16 and control inputs 18. A junction 20 is shown connecting first segment 12, second segment 14 and screen 16. User 8 is shown moving screen 16 between a first and a second position.

First housing segment 12 may include a first diorama or scene 22 with features and fixtures to simulate a beach scene. Second segment 14 may have a second distinct diorama or scene 24 simulating an ocean with features and fixtures. Video toy 10 may be programmed to present on video screen 16 a virtual character 26, described below, and shown in FIGS. 2 and 3. Video toy 10 may include control inputs 18 and a speaker 28 for user interaction with virtual character 26.

Transparent screen 16 may be mounted for movement or articulation relative to housing 11 at junction 20. For example, transparent screen 16 may be moved between a first position adjacent to first diorama 22 and a second position adjacent to second diorama 24. Each diorama may be visible through screen 16 when the screen is at each respective position. Virtual character 26 may be displayed on video screen 16 and the associated diorama may be visible through the screen when the screen is in the first or the second position.

When the screen is in one of these positions, the character may appear to be superimposed on and/or be part of the diorama. Character 26 may appear to engage in activities related to or associated with the situational context or theme of the diorama. Video screen 16 may also display images of other objects associated with the actions of virtual character 26. Character 26 may represent a human, an animal, other animate object, or even a normally inanimate object. More than one character and/or object may be displayed simultaneously.

Junction 20 may be of any suitable form that attaches screen 16 to housing segments 12 and 14, and at least allows movement of the screen between dioramas 22 and 24, and/or allows movement of one diorama relative to the other. Junction 20 in FIG. 1 is a hinge 29 with an axis 30. Junction 20 may instead be a universal joint or other connector that allows movement around multiple axes or translation of transparent screen 16. Toy 10 may include a sensor 32 supported by housing 11 and shown in FIG. 1 as a dotted line. Sensor 32 may detect movement of screen 16. Housing segment 12 and housing segment 14 may be fixed together and maintain a positional relationship. Alternatively, segment 12 and segment 14 may be connected by junction 20 and the segments may move in relation to each other about junction 20.

Figure 2:
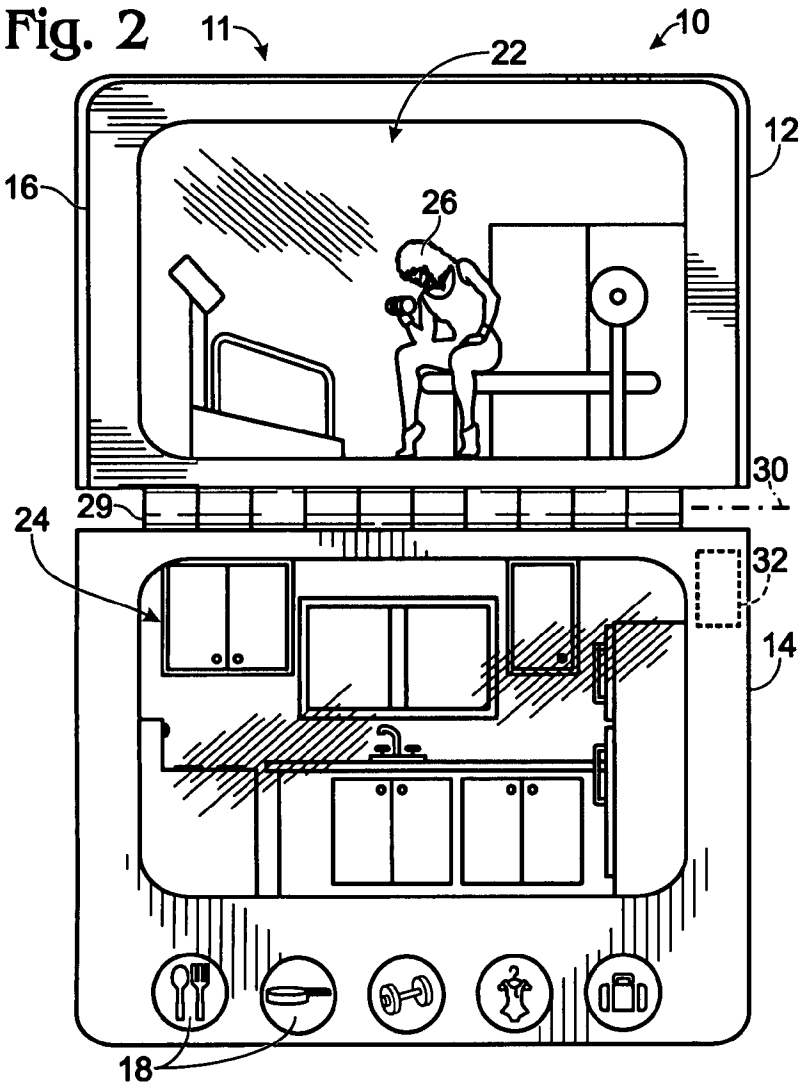
FIG. 2 is a perspective view of a video toy similar to FIG. 1 including the housing segments and dioramas, a sensor and a video screen in a first position in front of the first diorama, with a virtual character displayed on the video screen engaged in activities associated with the first diorama.

FIG. 2 is a perspective view of another embodiment of video toy 10. For clarity, similar numbering is used here and for the following figures for parts that are similar to the corresponding parts of the toy shown in the previous figure. Similar to the previous configuration, video toy 10 may have first segment 12, second segment 14, and transparent video screen 16, all interconnected by hinge 29 and may have control inputs 18. Video screen 16 is shown positioned adjacent to and in front of a first diorama of a gym with typical weight room features and fixtures such as a bench for lifting weights and a running machine. Virtual character 26 is shown lifting a barbell with the diorama visible through screen 16.

Figure 3:
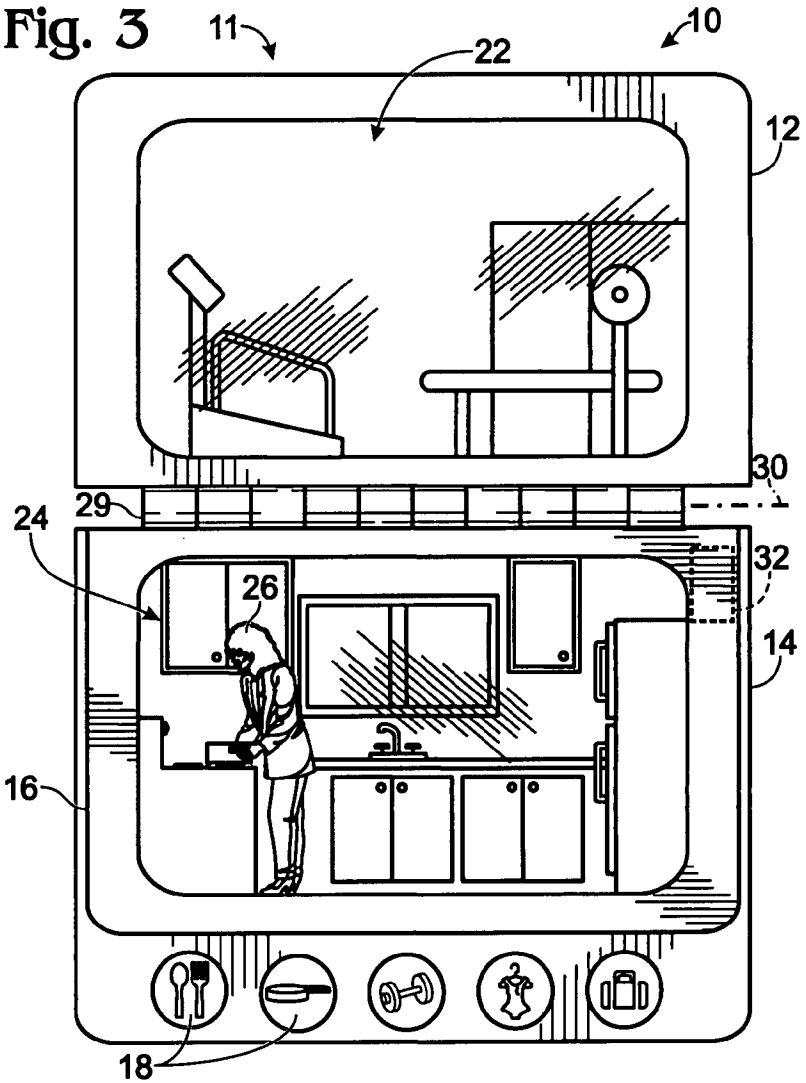
FIG. 3 is a perspective view of the video toy of FIG. 2, again including the housing segments and dioramas, but with the video screen in a second position in front of the second diorama and a virtual character displayed on the video screen engaged in activities associated with the second diorama.

FIG. 3 is another view of video toy 10 of FIG. 2 with the video screen moved to a new position adjacent to and in front of second diorama 24. The second diorama is shown as a kitchen with features and fixtures of a stove and a table and the diorama is visible through screen 16. Virtual character 26 is cooking and holding a pot and appears to be working at the stove of the diorama.

Figure 4:
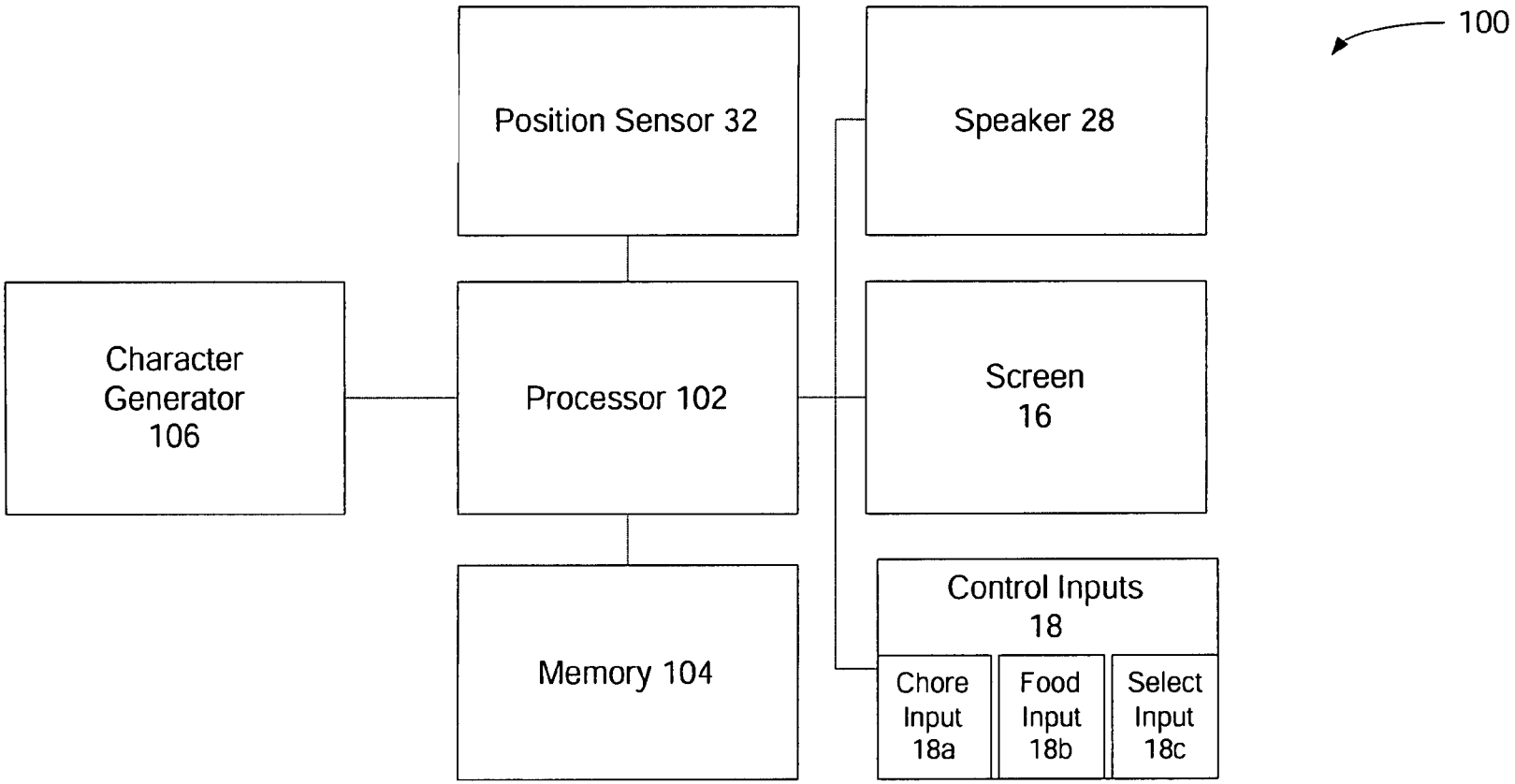
FIG. 4 is a component diagram showing functional components of the video toy including a processor, memory, a character generator, a sensor, control inputs, a video screen, a speaker and a screen position sensor.

FIG. 4 is an exemplary component system 100 of video toy 10. System 100 includes interconnected components. In this example, the components include screen 16, control inputs 18, speaker 28, screen position sensor 32*a* processor 102, memory 104 and a character generator or character processor 106. Processor 102 may be operably connected to screen 16, control inputs 18, speaker 28, screen position sensor 32, memory 104 and character generator 106. Character generator 106 may be implemented as an electric circuit, an integrated circuit or other component. Alternately, character generator 106 may be one or more software applications implemented by processor 102 and memory 104.

Character generator 106 may be programmed and/or configured to generate the image of virtual character 26 displayed on screen 16. Character generator 106 may be further programmed and/or configured to display character 26 as appearing to engage in activities, speak, interact with the user, display actions connoting emotions and/or elicit responses from the user. Character generator 106 may also generate images of objects, pets, additional characters and/or icons for user selectable options to be displayed on screen 16.

Screen position sensor 32 may respond to the position of screen 16 or to moving screen 16. Character generator 106 may respond to sensor 32 indicating rotation of screen 16 by modifying the display of character 26 to maintain a correct orientation with relation to the dioramas. Character generator 106 may rotate and/or invert displayed character 26 and/or translate character 26 from one section of screen 16 to another to maintain consistent character orientation. For example, character 26 may appear to walk from one diorama to the next as a user moves the screen from one diorama to the other.

Character generator 106 or other components of component system 100 may record user inputs at control inputs 18. Character generator 106 may be further programmed and/or configured to respond to accumulated user inputs by displaying character 26 engaging in additional activities, interactions and/or actions. Generator 106 may provide access to additional character interactions with a user, such as games described below.

User 8 may provide input to toy 10 and character 26 at control inputs 18. Control inputs 18 may be buttons, joysticks, switches or other appropriate inputs for player interaction. Each control input 18 may be associated with a type of activity. Examples of types of input activities may include any activities appropriate for a diorama theme such as doing chores, selecting clothes, eating, socializing or selecting objects on video screen 16.

Referring still to FIG. 4, control inputs 18 shown as examples include chore input button 18*a*; food input button 18*b* and select input button 18*c*. Pressing a button such as a chore button may evoke an appropriate reaction from virtual character 26 such as saying no and putting hands on hips. Character 26 may speak and other sounds associated with activities may be generated at speaker 28 as part of operating toy 10 and game play.

Additional and/or more frequent user input at control input 18 may result in modified responses from virtual character 26. Virtual character 26 may be displayed engaging in additional activities or actions over the course of game play. The additional activities may resemble personal development and/or improved skills and may be generated by character generator 106 in response to repeated or accumulated inputs by the player at control input 18. Periods with no input by the player may result in virtual character 26 displaying boredom or petulance. Long periods with no user input may cause virtual character 26 to simulate packing up and moving out of video toy 10.

User interaction with toy 10 and character 26 may include problem solving. Character generator 106 may be programmed to present problems or issues to user 8 on screen 16. Problems may be simple and require the user to press a specific input button to resolve the issue. For example, character 26 may indicate that they are hungry. User 8 may push control input food button 18*b* and character 26 may go to the refrigerator for food.

Problems may be more complex and user 8 may be required to select from several options to resolve the issue. Problem resolution options may be displayed on screen 16 and the user may use several buttons of control input 18 or press one or more buttons repeatedly to highlight the preferred option and then select the highlighted or indicated option. The selected option may not resolve the issue and user 8 may be required to select another option.

For example, character 26 may indicate that they are bored. Several options may be displayed that correspond to reading a book, watching television and/or calling a friend. User 8 may use a specific input such as select button 18*c* to select one option. Character 26 may accept the selected option or may reject the selected option. User 8 may then select another displayed option.

Personal development of character 26 may include resolving simple problems without user input and presenting more difficult problems to the user. Personal development may include being more polite and/or exhibiting more maturity. Personal development may include user access to additional activities and applications with character 26.

Character 26 may play a game with the user such as a guessing game. For example, a plurality of objects may be displayed for selection by the user. Character 26 may provide hints as to which object is the target object of the game. User 8 may use control inputs 18 to select a displayed object based on the hints from character 26.

Game play may involve accumulating and expending resources. Virtual character 26 may engage in activities that result in earning money. Money earning activities may include chores or a job. Character 26 may expend accumulated money in activities such as shopping. Screen 16 may display the amount of money character 26 has available to spend. User 8 may select the items that character 26 purchases when shopping by using control inputs 18.

Game play may include positioning characters on the screen. For example, a bird may be displayed on screen 16 appearing to fly in an open window of the diorama. Character 26 may have to catch the bird. User 8 may have to position character 26 using control inputs 18 to catch the bird using a net as the bird appears to fly across the diorama.

Video toy 10 may be configured to connect and interact with other similar video games and to display a second character 26 from the connected video toy. A character from a connected video toy may be displayed as a "visitor" on video screen 16 of toy 10. The visitor may interact with character 26 acting as a "host," the displayed interaction simulating visiting a friend. Toy 10 may include a male and a female connector to plug into connectors of one or more similar video toys with similar connectors. Toy 10 may make a wireless connection to one or more other toys using a radio, infrared or a different kind of signal. Toy 10 may connect to other toys using a plug-in cable.

Dioramas may be two dimensional or three dimensional. Dioramas may comprise printed images and/or three dimensional objects. During play, dioramas may be stacked vertically, positioned side by side or may be oriented at right angles to each other. Dioramas may have depth. The hinge axis 30 may be vertical rather than horizontal. Alternatively, hinge 29 may be a universal joint that allows motion of screen 16 about more than one axis hinge 29 may allow translational motion of screen 16 and/or housing segments 12 and 14.

Figure 5:
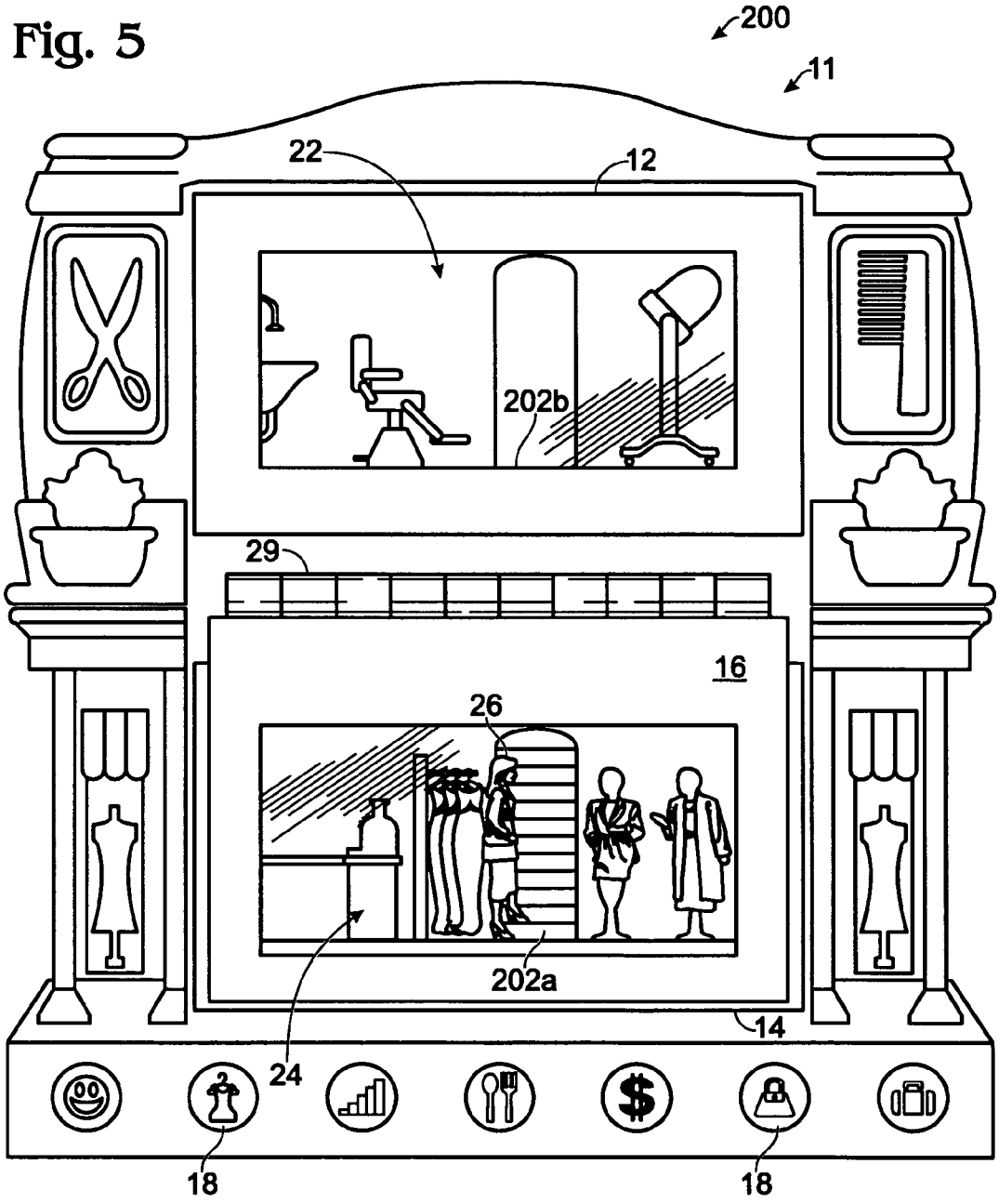
FIG. 5 is a perspective view of an exemplary video toy with a first diorama of a dress shop and a second diorama of a hair salon above the first diorama with the video screen positioned in front of the lower dress shop and the virtual character displayed going up the stairs to the second diorama.

FIG. 5 is a perspective view of another embodiment of a video toy 200 similar to video toy 10 of FIG. 1. First diorama 22 is shown with features and fixtures configured to resemble a clothes shop. Second diorama 24 is positioned above and adjacent to first diorama 22 and is configured to resemble a hair salon. Stairs 202 appear to connect first and second dioramas. Screen 16 in the figure is positioned adjacent to and in front of first diorama 22 with virtual character 26 appearing to climb stairs 202*a* to the second diorama.

Figure 6:
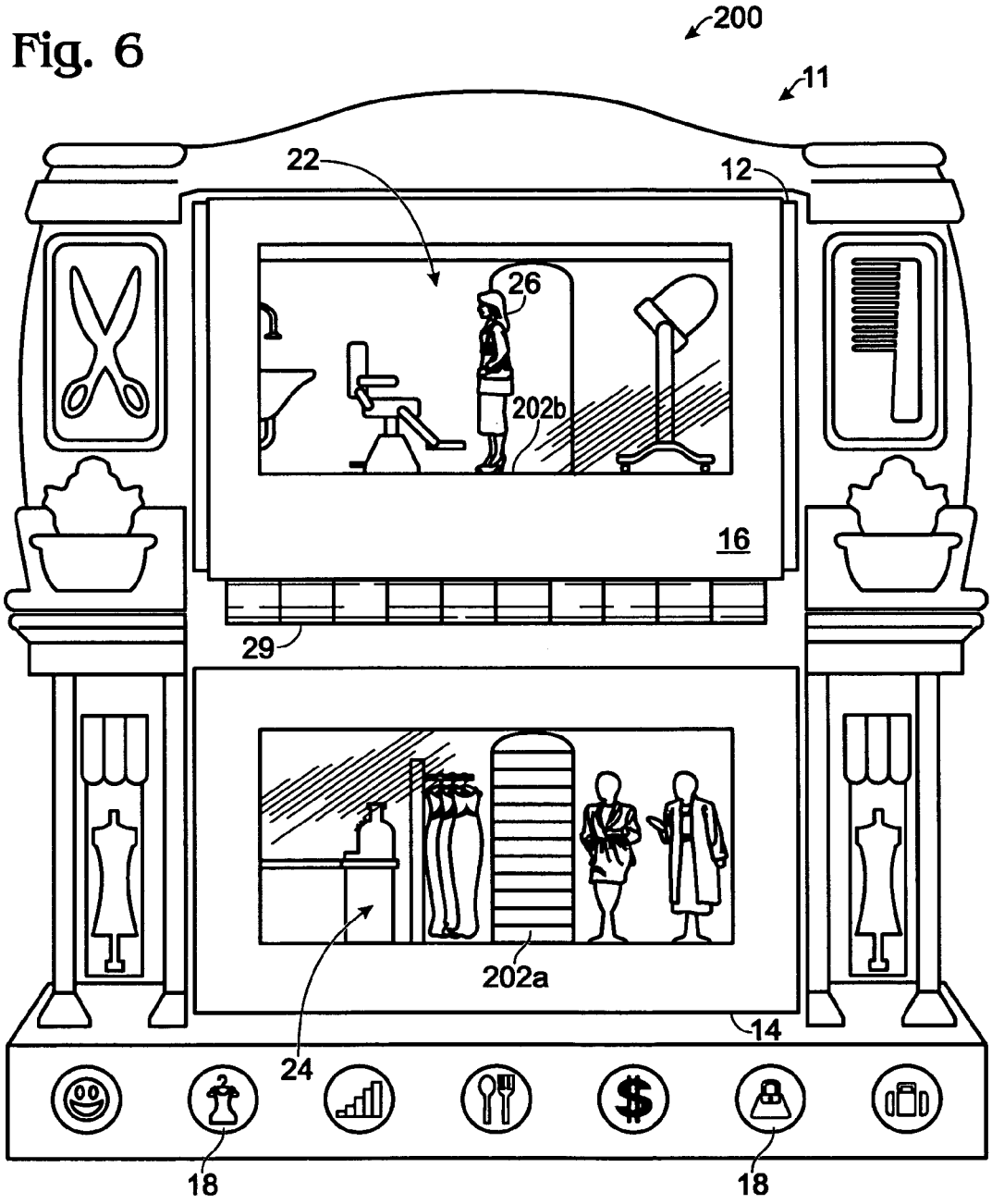
FIG. 6 is a perspective view of the video toy of FIG. 5 with the video screen rotated to a position in front of the upper diorama hair salon with the virtual character displayed entering the shop from the stairs.

FIG. 6 is a perspective view of video toy 200 with screen 16 rotated about hinge or hinge 29 to a position adjacent to and in front of second diorama 24. Character 26 is displayed at the top of stairs 202*b* entering the hair salon. Character 26 in this figure is viewed from the opposite side of the screen than when viewed with the screen in the position of FIG. 5. Character 26 has been rotated and/or inverted about a horizontal axis parallel to hinge axis 30 and moved from one area of the screen to another area to maintain a continuity of orientation for character 26. Without rotation and translation of character 26, on rotating the screen, character 26 may appear upside down and in a different location in the diorama when viewed from the opposite side.

Character 26 may exit and enter a diorama through a door. Character 26 may exit a first diorama through one door and enter a second diorama through a second door. Other characters may also enter and leave the diorama.

Figure 7:
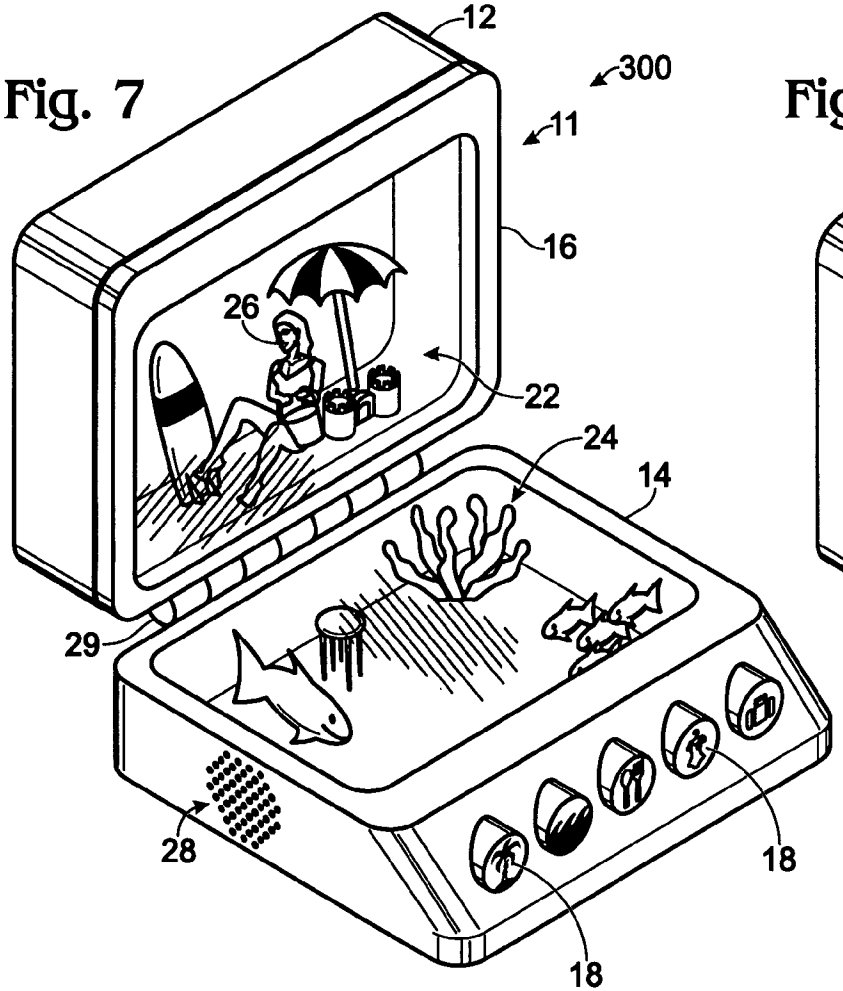
FIG. 7 is a perspective view of an exemplary video toy showing a first diorama of a beach scene and a second diorama of an ocean scene with the video screen positioned in front of the first beach scene diorama and displaying a virtual character.

FIG. 7 is a perspective view of another embodiment of video toy 300 similar to video toy 10 including screen 16, control inputs 18, first diorama 22 and second diorama 24. First diorama 22 may be configured to resemble a beach scene with a lifeguard stand and surfboards. Second diorama 24 is configured to resemble an ocean with coral and fish. In use and during play, first housing segment 12 of toy 10 may be positioned vertically and second housing segment 14 may be positioned horizontally or flat on a surface. Screen 16 may be positioned in front of first diorama 22 with characters displayed in appropriate attire. Character 26 may appear to walk towards the ocean depicted in adjacent diorama 24 to swim.

Figure 8:
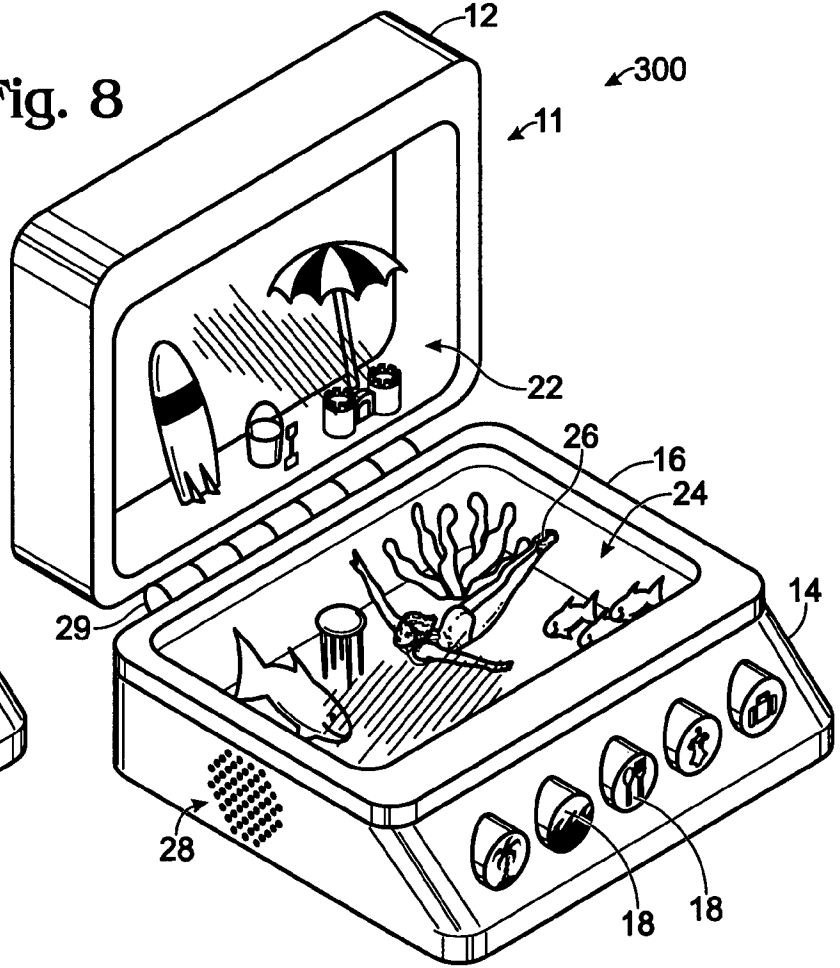
FIG. 8 is a perspective view of the video toy of FIG. 7 showing the video screen rotated to a position above and adjacent the ocean diorama with a displayed virtual character appearing to swim in the ocean.

FIG. 8 is another view of video toy 300 including screen 16, control inputs 18, first diorama 22 and second diorama 24.

Screen 16 has been moved to a position adjacent to and above second ocean diorama 24. Character 26 appears to have moved from diorama 22 to diorama 24 and appears to be swimming among fish and coral.

For the purpose of this disclosure, positioning of screen 16 adjacent or proximate to a diorama means the diorama is vicinal to and visible through the screen such that screen 16 will superimpose the image of virtual character 26 on the diorama. Reversing or inverting the image of virtual character 26 may include rotating the image about an axis passing through the image to maintain an orientation of the character consistent with the diorama. The axis of rotation or inversion may be horizontal or vertical.

Figure 9:
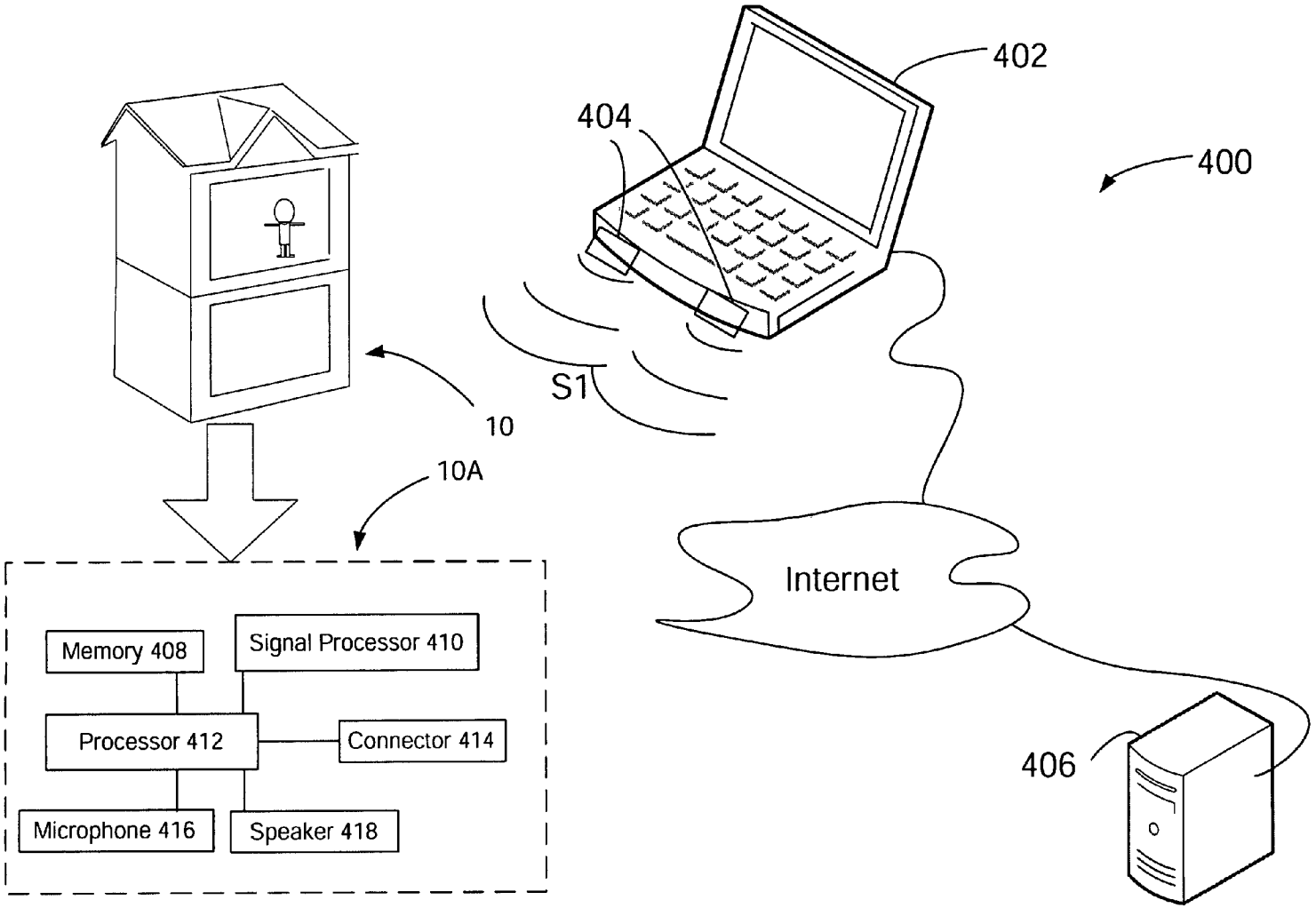
FIG. 9 is an exemplary component diagram including a video toy, a computer with speakers and a server connected to the computer through the internet, the video toy shown with internal components including memory, a signal processor, a microprocessor, a connector, a microphone and a speaker.

Video toy 10 may be associated with a computer and may respond to signals from the computer. FIG. 9 is a component diagram 400 showing video toy 10, electronic circuitry 10A of toy 10, computer 402 with speakers 404 and server 406. Video toy electronic circuitry 10A may include memory 408, a signal processor 410, a processor 412, a connector 414, microphone 416 and speaker 418. Processor 412 may be operably connected to speaker 418, memory 408, signal processor circuit 410, connector 414 and microphone 416.

Computer 402 may connect to server 406 over the internet. Server 406 or computer 402 may include software associated with video toy 10. Toy software at server 406 or computer 402 may generate electrical signals. The electrical signals may be converted to acoustic signals S1 at computer speaker 404. Acoustic signal S1 may be received at microphone 416 and converted to an electrical signal at signal processor 410. Toy 10 may recognize and respond to the signals from server 406 or computer 402.

Responding to the audio signal received at microphone 416 may include storing a game in memory 408 or providing access to a game previously saved in toy memory. Responding to the signal may include accessing or storing audio files in memory 408 that may be used to generate sounds at speaker 418.

Figure 10:
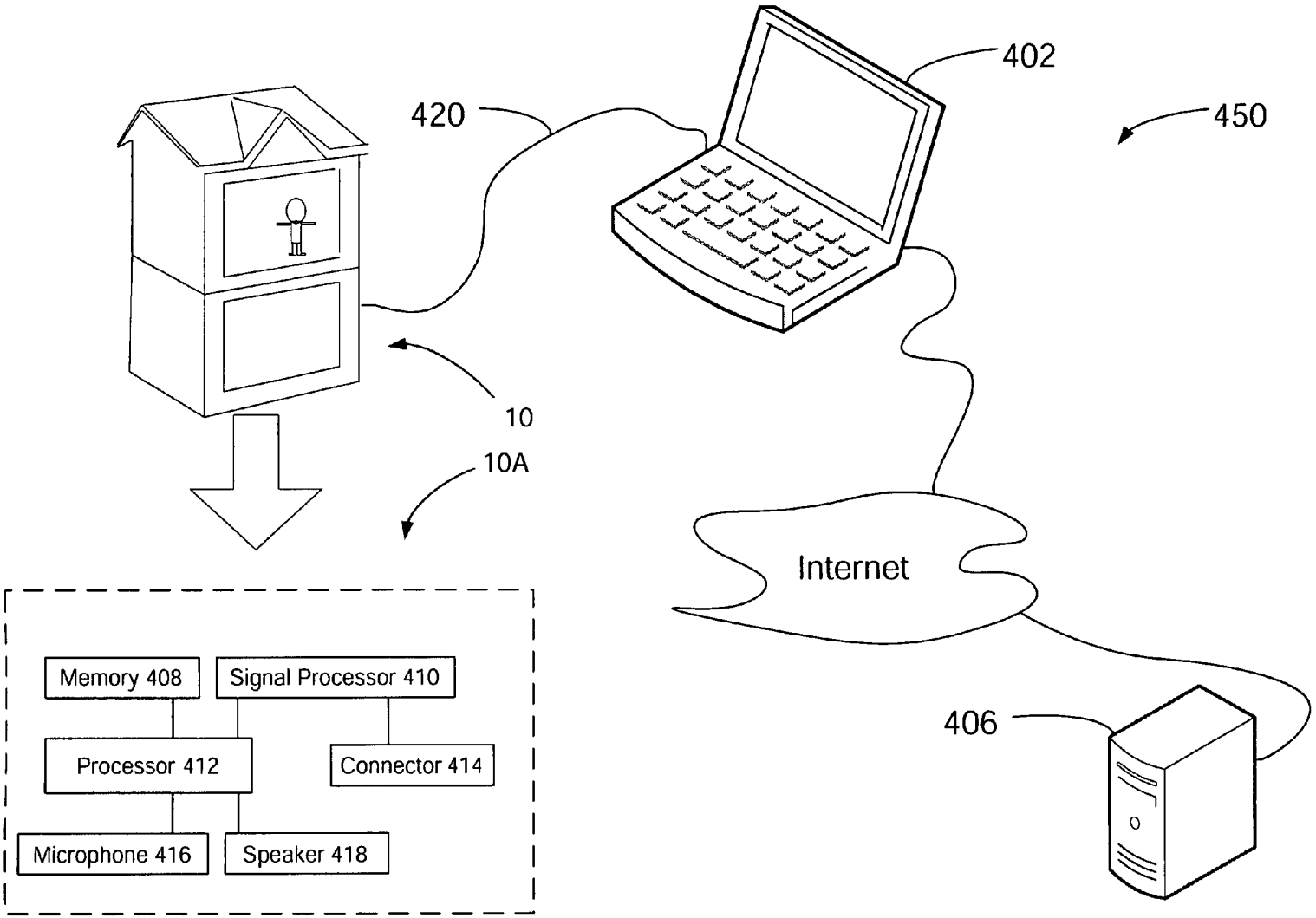
FIG. 10 is an exemplary component diagram including a video toy connected to a computer by a cable and a server connected to the computer through the internet, the video toy shown with internal components including memory, a signal processor, a microprocessor, a connector, a microphone and a speaker.

Video toy 10 may instead connect to a computer using a cable. FIG. 10 is a component diagram 450 showing video toy 10, electronic circuitry 10A of toy 10, computer 402, server 406 and cable 420. Video toy electronic circuitry 10A may include memory 408, a signal processor circuit 410, a processor 412, a connector 414 and speaker 418. Processor 412 may be operably connected to memory 408, signal processor circuit 410, connector 414 and speaker 418. Cable 420 may connect toy 10 to computer 402 or other networked processor based equipment. Computer 402 may connect to server 406 over the internet. Server 406 may include software associated with video toy 10. Toy software at server 406 may generate electrical signals that are received at toy 10. Signal processor circuit 410 may recognize and respond to the specific signals from server 406.

Responding to the signal received through connector 414 and cable 420 may include accessing or storing audio files in memory 408 that may be used to generate sounds at speaker 418. Responding to the signal may include storing a game in memory 408 or providing access to a game, application or file previously stored in toy memory. Responding to the signal may include transferring software and applications from the server to toy 10.

Computer 402 as used in this disclosure includes laptop computers, personal data assistants, telephones or other processor based electronics. Cable 420 may be a USB cable, an audio cable with terminations commonly referred to as RCA connectors or other signal conducting cable with compatible terminations between computer 402 and toy 10. Toy speaker 418 may generate sounds as part of game play. Virtual characters may speak or character activities during game play may have associated noises generated at toy speaker 418. Toy 10 may include indicator lights such as LEDs. Signal processor 410 may be a software application rather than an electronic circuit. Alternatively, signal processor 410 may be an electronic circuit.

While embodiments of a video toy and methods of use have been particularly shown and described, many variations may be made therein. This disclosure may include one or more independent or interdependent inventions directed to various combinations of features, functions, elements and/or properties, one or more of which may be defined in the following claims. Other combinations and sub-combinations of features, functions, elements and/or properties may be claimed later in this or a related application. Such variations, whether they are directed to different combinations or directed to the same combinations, whether different, broader, narrower or equal in scope, are also regarded as included within the subject matter of the present disclosure. An appreciation of the availability or significance of claims not presently claimed may not be presently realized. Accordingly, the foregoing embodiments are illustrative, and no single feature or element, or combination thereof, is essential to all possible combinations that may be claimed in this or a later application. Each claim defines an invention disclosed in the foregoing disclosure, but any one claim does not necessarily encompass all features or combinations that may be claimed. Where the claims recite "a" or "a first" element or the equivalent thereof, such claims include one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

We claim:

1. A video toy to display a virtual character comprising:

a housing including:

a first housing segment with a first diorama;

a second housing segment with a second diorama;

a transparent display screen mounted to the housing at a junction for movement in relation to the housing, the screen configured to be moved between a first position in which the first diorama is adjacent to and visible through the screen and a second position in which the second diorama is adjacent to and visible through the screen; and a character generator configured to generate and display images of the virtual character on the screen engaging in activities associated with the diorama adjacent to and visible through the screen.

2. The video toy of claim 1 wherein the junction for mounting the screen to the housing is a hinge with an axis and the screen is connected to the hinge along one edge.

3. The video toy of claim 1 further comprising a sensor, operably connected to the junction, to produce a sensor signal representative of the position of the screen.

4. The video toy of claim 3 wherein the character generator is responsive to the sensor signal to alter display of the virtual character to orient the virtual character with the diorama adjacent to and visible through the screen.

5. The video toy of claim 1 further comprising a control input coupled to the character generator for generating input signals.

6. The video toy of claim 1 wherein the virtual character gains resources as part of at least one activity and the virtual character engages in additional activities requiring expending the resources.

7. The video toy of claim 1 wherein the housing moves between an open and a closed position by rotating the first and second housing segments about the junction where:

in the closed position the first and second dioramas are proximate and face each other; and in the open position the first and second dioramas are spaced apart.

8. A virtual character generation system comprising:

a housing including:

a first diorama with a first theme;

a second diorama with a second theme distinct from the first theme;

a movable screen connected to the housing to display a virtual character that engages in activities; and a character generator operably connected to the screen and configured:

in response to positioning the screen adjacent to the first diorama, to generate and display the virtual character engaging in a first activity; and in response to positioning the screen adjacent to the second diorama, to generate the virtual character engaging in a second activity.

9. The virtual character generation system of claim 8 wherein the first activity is related to the first theme and the second activity is related to the second theme.

10. The virtual character generation system of claim 8 wherein the virtual character appears to move from the first diorama to the second diorama as the screen is moved from a first position adjacent to the first diorama to a second position adjacent to the second diorama, and the character generator orients the virtual character with the dioramas.

11. The virtual character generation system of claim 10 wherein the character generator maintains a virtual character orientation continuity at least in part by translating the position of the virtual character on the screen.

12. The virtual character generation system of claim 10 wherein the character generator maintains a virtual character orientation continuity at least in part by translating the position of the virtual character on the screen.

13. The virtual character generation system of claim 8 further comprising a user control input, wherein the character generator is further configured, in response to input from a user at the control input, to portray the virtual character as engaging in additional activities.

* * * * *